US007758724B2

(12) United States Patent
Akai et al.

(10) Patent No.: US 7,758,724 B2
(45) Date of Patent: Jul. 20, 2010

(54) BULKY WATER-DISINTEGRATABLE CLEANING ARTICLE AND PROCESS FOR PRODUCING WATER-DISINTEGRATABLE PAPER

(75) Inventors: Hiroyuki Akai, Tochigi (JP); Kazuo Mori, Tochigi (JP); Shusuke Kakiuchi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/353,889

(22) Filed: Jan. 14, 2009

(65) Prior Publication Data

US 2009/0126885 A1 May 21, 2009

Related U.S. Application Data

(62) Division of application No. 11/206,027, filed on Aug. 18, 2005, now abandoned.

(30) Foreign Application Priority Data

| | | |
|---|---|---|
| Aug. 20, 2004 | (JP) | 2004-241481 |
| Nov. 26, 2004 | (JP) | 2004-342876 |
| Nov. 26, 2004 | (JP) | 2004-342961 |

(51) Int. Cl.

| | |
|---|---|
| ***B31F 1/07*** | (2006.01) |
| ***D21H 21/24*** | (2006.01) |
| ***D21H 17/25*** | (2006.01) |
| ***D21H 23/26*** | (2006.01) |

(52) U.S. Cl. ..... 162/117; 162/135; 162/158; 162/175; 162/177; 156/209

(58) Field of Classification Search ..... 162/109, 162/117, 135, 158, 164.1, 175, 177; 428/156, 428/172, 340; 424/402; 156/60, 183, 209, 156/219

See application file for complete search history.

(56) References Cited

U.S. PATENT DOCUMENTS 1,883,526 A * 10/1932 Bryan ..... 162/117

(Continued)

FOREIGN PATENT DOCUMENTS

CN 1233677 11/1999

(Continued)

OTHER PUBLICATIONS

C. J. Biermann, "Essentials of Pulping and Papermaking," 1993, Academic Press, Inc., pp. 209.*

(Continued)

*Primary Examiner*—José A Fortuna
(74) *Attorney, Agent, or Firm*—Birch, Stewart, Kolasch & Birch, LLP

(57) ABSTRACT

A bulky, water-disintegratable cleaning article is formed of water-disintegratable paper impregnated with 100% to 500% by weight of an aqueous agent. The water-disintegratable paper is a substantially water dispersible fibrous sheet containing a water soluble or swellable binder. The water-disintegratable paper has a great number of protrusions and depressions formed by embossing and has a basis weight of 30 to 150 g/m$^2$. The bulky, water-disintegratable cleaning article has a thickness $T_1$ of 1.0 to 3.0 mm under a load of 0.3 kPa and a thickness $T_2$ of at least 0.9 mm under a load of 1.0 kPa.

10 Claims, 4 Drawing Sheets

U.S. PATENT DOCUMENTS

| | | | | | |
|---|---|---|---|---|---|
| 3,806,406 | A * | 4/1974 | Ely | 162/206 |
| 3,953,638 | A * | 4/1976 | Kemp | 428/154 |
| 4,260,443 | A * | 4/1981 | Lindsay et al. | 156/220 |
| 4,420,372 | A * | 12/1983 | Hostetler | 162/280 |
| 4,720,325 | A * | 1/1988 | Rausing et al. | 162/110 |
| 4,849,054 | A * | 7/1989 | Klowak | 162/109 |
| 5,091,032 | A * | 2/1992 | Schulz | 156/219 |
| 5,126,015 | A * | 6/1992 | Pounder | 162/206 |
| 5,264,269 | A | 11/1993 | Kakiuchi et al. | |
| 5,281,306 | A | 1/1994 | Kakiuchi et al. | |
| 5,314,584 | A * | 5/1994 | Grinnell et al. | 162/109 |
| 5,830,321 | A * | 11/1998 | Lindsay et al. | 162/204 |
| 5,871,615 | A * | 2/1999 | Harris | 162/140 |
| 5,935,880 | A | 8/1999 | Wang et al. | |
| 6,187,141 | B1 | 2/2001 | Takeuchi et al. | |
| 6,248,211 | B1 * | 6/2001 | Jennings et al. | 162/111 |
| 6,361,784 | B1 * | 3/2002 | Brennan et al. | 424/402 |
| 6,395,136 | B1 * | 5/2002 | Andersson et al. | 162/358.5 |
| 6,398,909 | B1 * | 6/2002 | Klerelid | 162/109 |
| 6,416,623 | B1 * | 7/2002 | Hollmark et al. | 162/109 |
| 6,451,718 | B1 | 9/2002 | Yamada et al. | |
| 6,503,370 | B2 * | 1/2003 | Hollmark et al. | 162/117 |
| 6,514,382 | B1 * | 2/2003 | Kakiuchi et al. | 162/109 |
| 6,524,683 | B1 * | 2/2003 | Roussel et al. | 428/172 |
| 6,585,861 | B2 * | 7/2003 | Odhe et al. | 162/280 |
| 6,596,127 | B2 * | 7/2003 | Hollmark et al. | 162/206 |
| 6,750,165 | B2 | 6/2004 | Kakiuchi et al. | |
| 6,863,107 | B2 * | 3/2005 | Hein et al. | 156/470 |
| 6,897,168 | B2 | 5/2005 | Branham et al. | |
| 6,913,673 | B2 * | 7/2005 | Baggot et al. | 162/117 |
| 2002/0060008 | A1 | 5/2002 | Hollmark et al. | |
| 2002/0106478 | A1 | 8/2002 | Hayase et al. | |
| 2002/0107495 | A1 * | 8/2002 | Chen et al. | 604/365 |
| 2003/0027473 | A1 | 2/2003 | Kakiuchi et al. | |
| 2003/0045197 | A1 | 3/2003 | Kakiuchi et al. | |
| 2004/0058600 | A1 | 3/2004 | Bunyard et al. | |
| 2005/0087317 | A1 | 4/2005 | Rydell | |
| 2005/0098281 | A1 * | 5/2005 | Schulz et al. | 162/117 |
| 2005/0103434 | A1 * | 5/2005 | Andersson et al. | 156/291 |
| 2005/0103456 | A1 * | 5/2005 | Hein et al. | 162/117 |
| 2005/0247397 | A1 * | 11/2005 | Kraus et al. | 156/209 |
| 2006/0037724 | A1 | 2/2006 | Akai et al. | |
| 2006/0096051 | A1 | 5/2006 | Akai et al. | |
| 2006/0278357 | A1 * | 12/2006 | Suzuki et al. | 162/117 |
| 2009/0123707 | A1 * | 5/2009 | Skoog et al. | 428/172 |
| 2009/0126885 | A1 * | 5/2009 | Akai et al. | 162/117 |

FOREIGN PATENT DOCUMENTS

| | | | |
|---|---|---|---|
| EP | 0372388 | A2 | 6/1990 |
| EP | 372388 | A2 | 6/1990 |
| EP | 421163 | A2 | 4/1991 |
| EP | 1209270 | A1 | 5/2002 |
| EP | 1630288 | A1 | 3/2006 |
| JP | 02074694 | A | 3/1990 |
| JP | 2-149237 | A | 6/1990 |
| JP | 3-113098 | A | 5/1991 |
| JP | 3-113099 | A | 5/1991 |
| JP | 3-292924 | A | 12/1991 |
| JP | 8-260397 | A | 10/1996 |
| JP | 10014807 | A | 1/1998 |
| JP | 11206661 | A | 8/1999 |
| JP | 2000-080599 | A | 3/2000 |
| JP | 2001-198066 | A | 7/2001 |
| JP | 1201796 | A1 | 5/2002 |
| JP | 1211342 | A1 | 6/2002 |
| JP | 2002-526689 | A | 8/2002 |
| JP | 2004-105710 | A | 4/2004 |
| JP | 2005-194635 | A | 7/2005 |
| JP | 2006-081883 | A | 3/2006 |
| JP | 2006-150695 | A | 6/2006 |
| JP | 2007209657 | A | 8/2007 |
| WO | WO-9735510 | A1 | 10/1997 |
| WO | WO-00/20684 | A1 | 4/2000 |

OTHER PUBLICATIONS

English language abstract of JP 05 148799 A (Jun. 15, 1993).
English language abstract of JP 02 074694 A (Mar. 14, 1990).
English language abstract of JP 03 193996 A (Aug. 23, 1991).

* cited by examiner

BULKY WATER-DISINTEGRATABLE CLEANING ARTICLE AND PROCESS FOR PRODUCING WATER-DISINTEGRATABLE PAPER

This application is a Divisional of application Ser. No. 11/206,027, filed on Aug. 18, 2005, now abandoned, and for which priority is claimed under 35 U.S.C. §120. This application also claims priority to Japanese Applications JP2004-241481 filed on Aug. 20, 2004, JP2004-342876 filed on Nov. 26, 2004, and JP2004-342961 filed on Nov. 26, 2004 in the Japan Patent Office under 35 U.S.C. §119. The entire contents of all are hereby incorporated by reference.

FIELD OF THE INVENTION

The present invention relates to a bulky, water-disintegratable cleaning article and a process of producing bulky, water-disintegratable paper.

BACKGROUND OF THE INVENTION

Applicant has previously proposed a water-disintegratable cleaning sheet having water-disintegratable paper impregnated with an aqueous cleaning agent (see JP-A-2-149237), in which the water-disintegratable paper is made by wet papermaking and contains a water soluble binder having a carboxyl group, and the aqueous cleaning agent contains a polyvalent metal ion and an organic solvent as essential ingredients. Applicant has also proposed a water-disintegratable cleaning article having water-disintegratable paper impregnated with a boric acid aqueous solution containing a water soluble solvent (see JP-A-3-292924), in which the water-disintegratable paper is made by wet papermaking and contains polyvinyl alcohol as a binder. These water-disintegratable cleaning articles have strength withstanding cleaning operation and good water disintegratability making them flushable. The water-disintegratable paper, i.e., a fibrous base sheet, of these water-disintegratable cleaning articles is made of non-heat-fusible and biodegradable cellulosic materials such as pulp to develop post-disposal water disintegratability.

In order to secure post-disposal biodegradability of water-disintegratable paper for applications inclusive of the cleaning articles, it is difficult to use heat fusible fiber that is generally non-biodegradable. Although fiber of biodegradable polylactic acid, etc. is among heat fusible fibers, such biodegradable fiber is expensive and not economical. Pulp is typical of biodegradable and inexpensive fibers.

Means for making paper made mainly of pulp bulky for applications inclusive of the cleaning articles include embossing between engraved rolls. Paper embossing techniques are roughly divided into dry embossing effected on dry paper and wet embossing effected on a wet fiber web on a papermaking machine before drying (see JP-A-8-260397). JP-A-8-260397 mentions that an embossed wet fiber web is dried in a drying step. In order to remove a quantity of water from a wet fiber web from a papermaking step, it is necessary to bring the wet web in contact with a yankee dryer or a multi-cylinder dryer to achieve high thermal efficiency. When such a drying method is adopted, it has been impossible to highly emboss the wet web to create high bulk. On the other hand, dry embossing, which is most commonly practiced, is effected on paper obtained by drying a wet fiber web from a papermaking step. When paper made primarily of non-heat-fusible fiber such as pulp is embossed, paper undergoes destruction of the fiber-to-fiber bonds (including hydrogen bonds and bonding via a binder), or fibers break. This results in reductions of paper strength and embossed shape retention (bulk retention). In applications as water-disintegratable cleaning articles, the dry embossed paper is subject to various external forces while it is processed into a final product, such as folding, cutting, impregnation with a cleaning solution, packaging, and container filling. In the meantime, the bulk created by the embossing is reduced. The tendency to the reductions in paper strength and bulk during post-embossing processings and cleaning operation is conspicuous where paper is highly embossed.

SUMMARY OF THE INVENTION

The present invention provides a bulky, water-disintegratable cleaning article including water-disintegratable paper and an aqueous agent impregnated in the water-disintegratable paper. The water-disintegratable paper has a basis weight of 30 to 150 g/m$^2$ and a substantially water dispersible fibrous sheet which contains at least one of a water soluble binder and a water swellable binder. The water-disintegratable paper has a number of protrusions and depressions formed by embossing. The amount of the aqueous agent impregnating the water-disintegratable paper is 100% to 500% by weight, based on the dry weight of the water-disintegratable paper. The cleaning article has a thickness $T_1$ of 1.0 to 3.0 mm under a load of 0.3 kPa and a thickness $T_2$ of at least 0.9 mm under a load of 1.0 kPa.

The present invention also provides a process of producing water-disintegratable paper including the step of embossing a substantially water dispersible fibrous sheet containing a water soluble or swellable binder and having a basis weight of 30 to 150 g/m$^2$ while the fibrous sheet has a water content of 10% to 200% by weight and the step of drying the fibrous sheet simultaneously with or immediately after the embossing.

The present invention also provides a process of producing water-disintegratable paper including the steps of adding an aqueous solution of a water soluble binder to a sheet containing a substantially water dispersible fiber and containing no water soluble binder to provide a fibrous sheet having a water soluble binder content of 1% to 30% by weight and a water content of 10% to 200% by weight based on the dry weight of the sheet, embossing the resulting fibrous sheet, and drying the fibrous sheet simultaneously with or immediately after the embossing.

DETAILED DESCRIPTION OF THE INVENTION

The present invention relates to a bulky, water-disintegratable cleaning article the strength of which has not been reduced by embossing and the bulk of which has not been reduced by post-embossing processings and will not be reduced when used as a wipe, etc., that is, a bulky, water-disintegratable cleaning article having satisfactory shape retention. The present invention also relates to a process of producing water-disintegratable paper including the step of embossing without involving reduction in bulk and strength accompanying embossing.

The present invention will be described based on its preferred embodiments with reference to the accompanying drawings. The premise of the present invention resides in that a substantially water dispersible fibrous sheet containing a water soluble or swellable binder is embossed to increase its thickness or bulk. The water-disintegratable paper obtained by embossing the fibrous sheet has a basis weight of 30 to 150 $g/m^2$, preferably 50 to 120 $g/m^2$, in its dry state. Impregnating the water-disintegratable paper with 100% to 500% by weight, preferably 100% to 300% by weight, of an aqueous agent gives the bulky, water-disintegratable cleaning article of the present invention. The bulky, water-disintegratable cleaning article has a thickness $T_1$ of 1.0 to 3.0 mm under a load of 0.3 kPa, which is a primary criterion representing increased bulk as aimed in the present invention.

Figure 1:
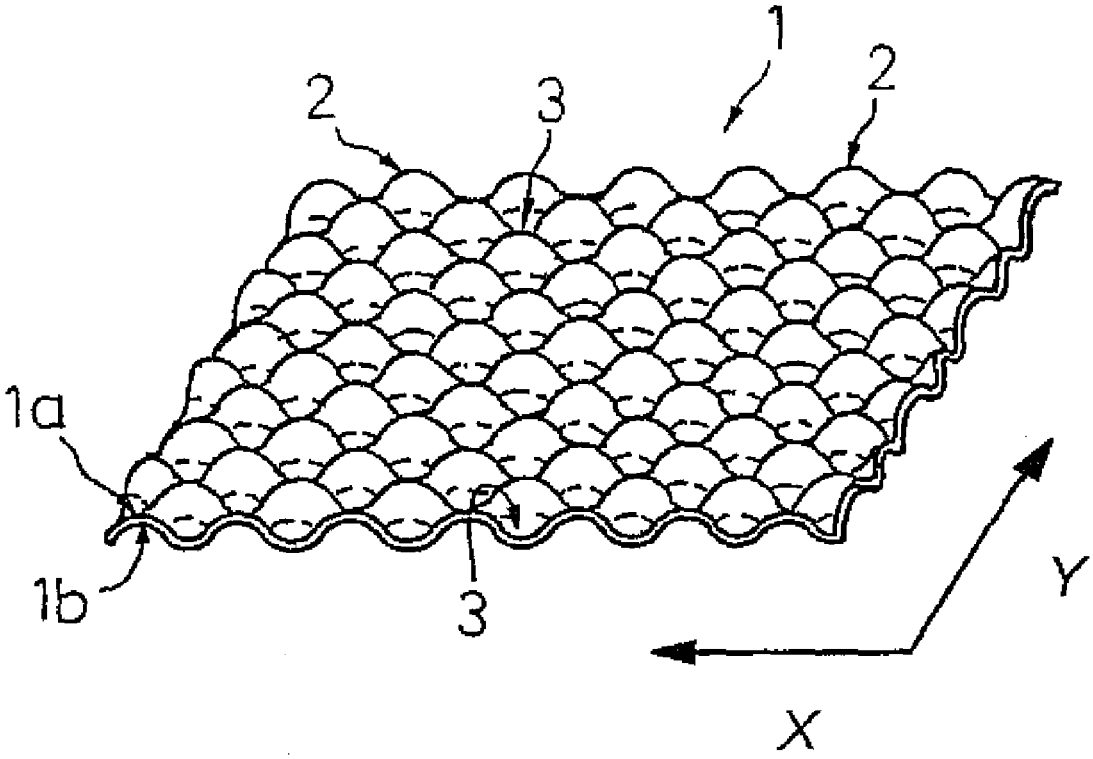
FIG. 1 is a perspective illustrating an embodiment of the water-disintegratable cleaning article according to the present invention

FIG. 1 represents a perspective view of a bulky, water-disintegratable cleaning article 1 (hereinafter simply referred to as "the cleaning article 1") according to an embodiment of the present invention. The cleaning article 1 has a first side 1*a* and a second side 1*b*. The cleaning article 1 has a great number of protrusions 2 protruding from one of the sides 1*a* and 1*b* toward the other side. The protrusions 2 are aligned at a regular interval in both the length direction X and the width direction Y of the cleaning article 1, totally making a diamond lattice pattern. Between every adjacent protrusions 2 along each of the length and width directions is there a depression 3 to make a diamond lattice pattern totally. Thus the cleaning article 1 has a three dimensional profile as a whole.

As stated, the cleaning article 1 is characterized by its high bulk. The thickness $T_1$ of the cleaning article 1 (i.e., the distance from the apices of protrusions 2 on the first side 1*a* to the apices of protrusions 2 on the second side 1*b*) under a load of 0.3 kPa is 1.0 to 3.0 mm, preferably 1.2 to 2.5 mm, more preferably 1.3 to 2.0 mm. Within that range of thickness $T_1$, the cleaning article 1 feels bulky like dustcloth and retains satisfactory strength. With a thickness $T_1$ smaller than 1.0 mm, the cleaning article 1 would not be felt noticeably bulkier than conventional cleaning sheets. It may be slightly inconvenient to use as a wipe and make a user feel insecure about dirt's striking therethrough. A cleaning article having a thickness $T_1$ exceeding 3.0 mm may have insufficient strength, and a packet of such thick cleaning articles would be bulky, which is uneconomical for disposable applications. The 0.3 kPa load under which thickness $T_1$ of the cleaning article 1 is measured is very light so that thickness $T_1$ approximates the apparent thickness of the cleaning article 1.

Besides being bulky, the cleaning article 1 should have thickness retention when a user holds her or his hand against the cleaning article 1 in a wiping operation. In the present invention, the force of a hand against the cleaning article is estimated at 1.0 kPa. When the bulky, water-disintegratable cleaning article (impregnated with an aqueous agent) has a thickness $T_2$ of 0.9 mm or larger measured under a load of 1.0 kPa, the cleaning article can be said to meet the above-described requirement for thickness retention. To ensure ease in wiping with a hand to give a thorough cleaning and to prevent dirt striking through, the thickness $T_2$ is preferably 1.0 mm or larger, more preferably 1.2 mm or larger. Understandably, $T_2$ does not exceed $T_1$.

It is preferred for embossed shape retention that the thickness ratio of $T_2$ to $T_1$ of the cleaning article 1 be 0.8 or greater, more preferably 0.85 or greater. With that thickness ratio being smaller than 0.8, desired embossed shape retention is not secured, and the bulk is collapsed easily when pressed with the hand, failing to give cloth-like softness or a sense of security. The $T_2/T_1$ thickness ratio is preferably 0.85 or greater with no particular upper limit. The closer the ratio to 1, the higher the bulk retention.

The $T_1$ and $T_2$ values are not greatly affected by the amount and the composition of the impregnating aqueous agent so that the aqueous agent content is not included in the conditions of measuring $T_1$ and $T_2$. If the amount of the aqueous agent is to be included in the measuring conditions, double the dry weight of the water-disintegratable paper, which is typical in the present invention, would be a suitable condition.

The fibrous sheet contains a substantially water dispersible fiber and a water soluble or swellable binder. This is indispensable to provide a bulky, water-disintegratable cleaning article and water-disintegratable paper which retain high bulk and exhibit satisfactory wet strength. The water soluble or swellable binder contributes to development of wet strength in the presence of the aqueous agent, embossed shape retention, and water disintegratability (flushability).

The substantially water dispersible fiber used in the fibrous sheet preferably has a fiber length of 15 mm or shorter, more preferably 10 mm or shorter, even more preferably 5 mm or shorter. For ease of obtaining both water disintegratability and wet strength, it is desirable to use primarily pulp fiber having a weight average fiber length of 0.5 to 3.0 mm. Rayon fiber or synthetic fiber having an average length of about 4.0 to 7.0 mm may be used in combination to improve the hand. Biodegradable fibers are preferably used, typically exemplified by cellulosic fibers including natural fibers such as pulp and cotton and semisynthetic fibers such as rayon. These fibers can be used either individually or as a combination of two or more thereof. Fibrillated fibers obtained by beating to an increased degree are also usable. Useful pulps include bleached wood pulps such as Nadelholz (needle-leaf) bleached craft pulp (NBKP) and Laubholz (broad-leaf) bleached kraft pulp (LBKP); other pulps such as hemp pulp; mercerized pulp (alkali-swollen pulp); chemically crosslinked pulp having a helical structure; and microfibrous cellulose. Synthetic fibers having no biodegradability including polyolefin fibers such as polyethylene and polypropylene and polyester fibers are also employable. Biodegradable synthetic fibers such as polylactic acid fiber are preferably used. It is preferred for the fibrous sheet to contain cellulosic fiber in a proportion of 70% to 100%, more preferably 80% to 100%, based on the total fiber weight.

The water soluble binder includes natural polysaccharides, polysaccharide derivatives, and synthetic polymers. Examples of the natural polysaccharides include sodium alginate, gum tragacanth, guar gum, xanthan gum, gum arabic, carrageenan, galactomannan, gelatin, casein, albumin, and pullulan. Examples of the polysaccharide derivatives include carboxymethyl cellulose, carboxyethyl cellulose, carboxymethylated starch and its salts, starch, methyl cellulose, and ethyl cellulose. Examples of the synthetic polymers include polyvinyl alcohol, polyvinyl alcohol derivatives, unsaturated carboxylic acid polymer or copolymer salts, and salts of copolymers of an unsaturated carboxylic acid and a monomer copolymerizable with the unsaturated carboxylic acid. The unsaturated carboxylic acids include acrylic acid, methacrylic acid, itaconic acid, crotonic acid, maleic anhydride, maleic acid, and fumaric acid. The amount of the water soluble binder to be used is subject to variation depending on the use of the final product and the kind of the binder. From the viewpoint of bulk retention, wet strength, water disintegratability, and economy, a preferred amount of the water soluble binder usually ranges from 1% to 30%, more preferably 2% to 15%, by weight based on the weight of the fibrous sheet. It is preferred that the water soluble binder be temporarily insolubilized in the presence of the aqueous agent having a high water content to function as a binder maintaining the fiber-to-fiber bonds thereby serving for retaining the bulk and strength during cleaning. The water content in the aqueous agent is preferably in a range of from 30% to 95%, more preferably 50% to 95%, even more preferably 60% to 95%, by weight, to secure ability of removing dried urine stains and to minimize possible irritation to the skin.

The above-mentioned temporary insolubilization of the water soluble binder is achieved by a sufficient amount of the aqueous agent impregnating the water-disintegratable paper and the presence of a binder-insolubilizing component in the water-disintegratable paper or the aqueous agent. While the amount of the aqueous agent to be infiltrated into water-disintegratable paper cannot be specified quantitatively as it depends on the kind, the molecular weight and the content of the binder in the water-disintegratable paper, it is preferably such that the most of the binder cannot dissolve. The binder insolubilizing component includes water soluble organic solvents and specific acids or electrolytes.

The water soluble organic solvents include monohydric alcohols, such as methanol, ethanol, and isopropyl alcohol; glycols, such as ethylene glycol, diethylene glycol, polyethylene glycol, propylene glycol, dipropylene glycol, butylene glycol, hexylene glycol, and 3-methyl-1,3-butanediol; mono- or diethers between these glycols and lower alcohols, e.g., methanol, ethanol, propanol, and butanol; esters between the glycols and lower fatty acids; and polyhydric alcohols, such as glycerol and sorbitol. The water soluble organic solvents can be used either individually or as a combination of two or more thereof. The concentration of the water soluble organic solvent in the aqueous agent is preferably 30% to 70% by weight, more preferably 30% to 60% by weight, even more preferably 30% to 50% by weight. Where used in combination with an acid or an electrolyte described below, the water soluble organic solvent is preferably used in a concentration of 1% to 50% by weight, more preferably 5% to 40% by weight, even more preferably 10% to 30% by weight.

The acid and the electrolyte that can be used as a binder insolubilizing component typically include those capable of temporarily insolubilizing water soluble binders through salting-out or crosslinking. Various salts can be used for salting-out as far as they are water soluble. Salts for crosslinking should be selected according to the kind of the binder. In using, for example, carrageenan or guar gum as a water soluble binder, a water soluble salt that releases a potassium ion in an aqueous agent and crosslinks with the binder to gelatinize the binder is chosen. In using a carboxylic acid-based binder, a water soluble salt that releases a divalent metal ion in an aqueous agent and crosslinks with the carboxylic acid-based binder in the presence of a small amount of a water soluble solvent is chosen. In using polyvinyl alcohol as a water soluble binder, boric acid or a borate such as sodium tetraborate that crosslinks with the binder to gelatinize the binder is chosen. While the concentration of the acid or electrolyte in the aqueous agent cannot be specified because it is subject to variation depending on the kind and the content of the binder in the water-disintegratable paper, it preferably ranges from 1% to 10% by weight, more preferably 1% to 5% by weight, taking the cleaning finish and irritation to the skin into consideration.

The aqueous agent is a composition containing the aforesaid binder insolubilizing component dissolved in a water medium. According to necessity, the aqueous agent may further contain various compounding ingredients, such as surfactants, sterilizers, chelating agents, bleaches, deodorants, and perfumes, to enhance the cleaning ability of the aqueous agent. The surfactants include anionic ones, nonionic ones, cationic ones, and amphoteric ones. To secure both cleaning action and finish, it is recommended to use nonionic ones such as polyoxyalkylene (number of moles of alkylene oxide added: 1 to 20) alkyl (straight-chain or branched, containing 8 to 22 carbon atoms) ethers, alkyl (straight-chain or branched, containing 8 to 22 carbon atoms) glycosides (average sugar condensation degree: 1 to 5), sorbitan fatty acid (straight-chain or branched; containing 8 to 22 carbon atoms) esters, and alkyl (straight-chain or branched, containing 6 to 22 carbon atoms) glyceryl ethers; or amphoteric ones, such as alkylcarboxybetaines, alkylsulfobetaines, alkylhydroxysulfobetaines, alkylamidocarboxybetaines, alkylamidosulfobetaines, and alkylamidohydroxysulfobetains, each having 8 to 24 carbon atoms in the alkyl moiety thereof.

The aqueous agent is infiltrated into the water-disintegratable paper in an amount of 100% to 500% by weight, preferably 100% to 300% by weight, based on the dry weight of the water-disintegratable paper.

The water swellable binder includes a fibrous carboxyl-containing cellulose derivative, a fibrous starch derivative, a fibrous hydroxyl-containing polyvinyl alcohol or a fibrous hydroxyl-containing polyvinyl alcohol derivative. More specifically, the water swellable binder includes fibrous polyvinyl alcohol, fibrous carboxymethyl cellulose, and fibrous carboxyethyl cellulose. Such a water swellable binder is usually mixed into a stock of pulp fiber, etc. for making a fibrous sheet. The content of the water swellable binder in the fibrous sheet is preferably 5% to 40% by weight, more preferably 8% to 30% by weight, even more preferably 10% to 25% by weight, in view of bulk retention, wet strength, water disintegratability, and economy. Similarly to the water soluble binders, it is preferred that the water swellable binder be temporarily suppressed from swelling in the presence of the aqueous agent having a high water content to function as a binder maintaining the fiber-to-fiber bonds thereby serving for retaining the bulk and strength during cleaning. Such temporary suppression of swell of the binder is achieved by the presence of a swell suppressing component. Swell suppressing components for fibrous polyvinyl alcohol include boric acid and boric acid salts, e.g., sodium tetraborate, and those for fibrous carboxyethyl cellulose include water soluble salts releasing divalent metal ions, such as a magnesium ion, a calcium ion, and a zinc ion.

There are various useful combinations of a water soluble or swellable binder and an insolubilizing component or a swelling suppressing component. Inter alia, a combination of a carboxylic acid-based water soluble binder and an aqueous agent containing a divalent metal ion and a water soluble organic solvent is suitable.

Of the carboxylic acid-based water soluble binders particularly preferred is an alkali metal salt of carboxymethyl cellulose hereinafter abbreviated as CMC). CMC preferably has a degree of etherification of 0.8 to 1.2, more preferably 0.85 to 1.1, to exhibit satisfactory binding performance and good affinity to a crosslinking agent hereinafter described. Considering handling properties in applying the binder to paper by spraying or like means, CMC preferably has a viscosity of 10 to 40 mPa·s, more preferably 15 to 35 mPa·s, in a 1% by weight aqueous solution at 25° C., of 2500 to 4000 mPa·s, more preferably 2700 to 3800 mPa·s, in a 5% by weight aqueous solution at 25° C., and of 1200 mPa·s or lower in a 5% by weight aqueous solution at 60° C.

The aqueous agent that is preferably combined with water-disintegratable paper containing a carboxylic acid-based water soluble binder is a composition containing 60% to 90% by weight of water, 8% to 35% by weight of a water soluble organic solvent, and 1% to 5% by weight of a water soluble divalent metal salt releasing at least one metal ion selected from the group consisting of alkaline-earth metals, e.g., calcium, magnesium, strontium, and barium, manganese, zinc, cobalt, and nickel. That formulation of the aqueous agent is preferred because of its ability to temporarily insolubilize the binder to develop sufficient wet strength and in view of its good water disintegratability. The water soluble divalent metal salt includes hydroxides, chlorides, sulfates, carbonates, formates, and acetates. Calcium chloride and zinc sulfate are particularly preferred of them.

The aqueous agent-impregnated water-disintegratable paper, namely the water-disintegratable cleaning article 1 preferably has a wet strength of 300 cN/25 mm or more in the machine direction (MD) and of 100 cN/25 mm or more in the cross direction (CD) from the standpoint of strength required for wiping. The MD wet strength is more preferably 400 cN/25 mm or more, even more preferably 500 cN/25 mm or more. The CD wet strength is more preferably 150 cN/25 mm or more, even more preferably 200 cN/25 mm or more.

Returning to FIG. 1, the individual protrusions 2 are almost hemispherical. The same applies to the depressions 3. It is preferred for the cleaning article 1 and the water-disintegratable paper according to the present embodiment to have equal cleaning performance on both the first side 1*a* and the second side 1*b*. In this connection, it is preferred that the shape and the spacing of the protrusions 2 on the first side 1*a* and those on the second side 1*b* be substantially the same. It is preferred that the back of the depressions 3 on the first side 1*a* correspond to the protrusions 2 on the second side 1*b* and vise versa. It is also preferred that the shape of the individual protrusions 2 be an inversion of the individual depressions 3.

Figure 2:
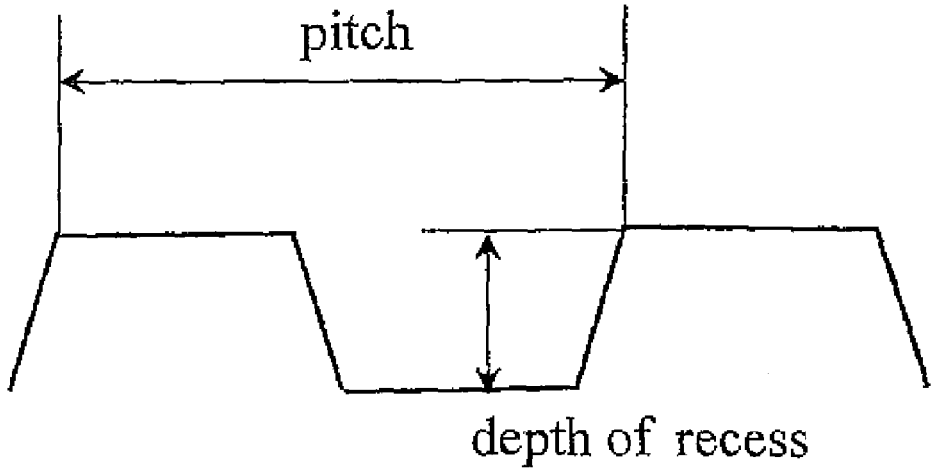
FIG. 2 is an enlarged cross-sectional view of an embossing roll.

The embossing pattern is not limited as long as the fibrous sheet becomes bulky by embossing. Embossing using matched steel embossing rolls is suitable to give high bulk, in which two engraved rolls having elevations and recesses aligned in a regular pattern on their surface are fully engaged with each other along the nip line. The elevations and recesses (see FIG. 2) are preferably aligned at a pitch of 3.5 to 14.0 mm, more preferably 5.0 to 10.0 mm, and with a difference between the top of the elevations and the bottom of the recesses, namely, the depth of the recesses of 1 to 5 mm, more preferably 1.5 to 4.5 mm, even more preferably 2 to 4 mm, in order to secure high bulk in the cleaning article 1 and the water-disintegratable paper.

The average number of the protrusions 2 formed on one side of the cleaning article 1 and the water-disintegratable paper is preferably 50 to 850, more preferably 100 to 600, per 10 cm square at any site on that side. With the density of the protrusions 2 falling within that range, the cleaning article 1 and the water-disintegratable paper have protrusions 2 and depressions 3 arranged in good balance and therefore exhibit still superior performance in removing dirt.

As will be understood from preferred processes of producing water-disintegratable paper described infra, the shape and arrangement of the protrusions 2 and the depressions 3 can be freely designed by designing the engraving pattern on an engraved roll used in the production.

Preferred processes of producing water-disintegratable paper serving as a base material of the cleaning article 1 will then be described. The water-disintegratable paper is produced by the step of embossing a substantially water dispersible fibrous sheet containing a water soluble or swellable binder and having a basis weight of 30 to 150 g/m$^2$ while the fibrous sheet has a water content of 10% to 200% by weight and the step of drying the fibrous sheet either simultaneously with or immediately after the embossing. The water-disintegratable paper is also produced by the step of adding an aqueous solution of a water soluble binder to a sheet containing a substantially water dispersible fiber and containing no binder to provide a fibrous sheet having a water soluble binder content of 1% to 30% by weight and a water content of 10% to 200% by weight based on the dry weight of the sheet and the step of embossing and drying the resulting fibrous sheet simultaneously.

The water soluble binder-containing, water dispersible fibrous sheet can be prepared in various methods. For example, it is known that water-disintegratable paper containing a predetermined amount of a water soluble binder is obtained from a pulp dispersion, namely, a pulp stock containing a water soluble binder and a fixative for fixing the water soluble binder to the pulp fiber (see JP-A-3-193996). It is possible to prepare water-disintegratable paper containing a predetermined amount of a water soluble binder by forming a sheet from a pulp stock, press dewatering or half drying the sheet, and applying the water soluble binder with a spray or like means, followed by drying. A pre-drying system using a hot air blow-through dryer is preferred to press dewatering to give low-density paper having higher water disintegratability. It is also possible to produce a fibrous sheet by dispersing and laying pulp fibers in a dry process (without using water) to form a web, applying a water soluble binder with a spray or like means, and drying (i.e., air laying process).

Figure 3:
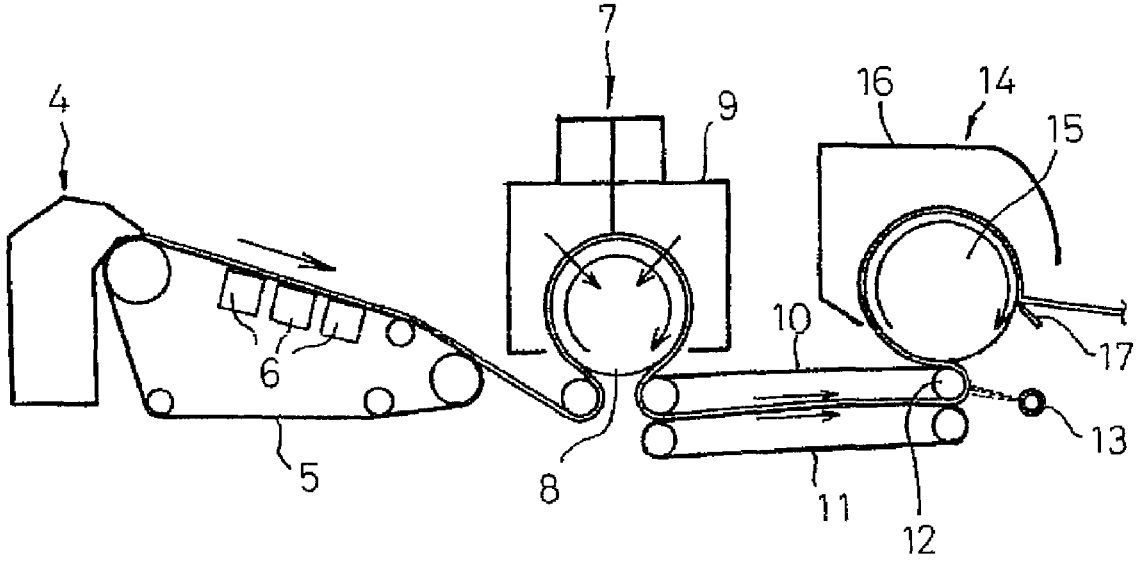
FIG. 3 is a schematic illustration of a paper machine used in the preparation of water-disintegratable paper.

FIG. 3 schematically illustrates an example of apparatus (wet process paper machine) that is preferably used in the production of a water soluble binder-containing, water dispersible fibrous sheet. The apparatus shown in FIG. 3 is comprised of a former (or a headbox) 4, a wire part, a first dryer part 7, a spray part, and a second dryer part 14. The former 4 is a chamber in which a stock supplied from a stock preparation section (not shown) is diluted to a prescribed concentration and dispensed evenly onto a moving wire 5 of the wire part. The stock preparation section has a refiner where pulp fiber, etc. is defibrated and refined and a mixing chamber where additives, such as sizing agents, pigments, paper strength additives, bleaches, and flocculants, are added to the refined fiber to prepare a stock having a predetermined fiber concentration according to desired characteristics of water-disintegratable paper to be produced. A binder may be mixed into the stock in the stage of stock preparation. In the wire part, the finished stock spread on the moving wire 5 by the former 4 is dewatered into a wet web. The wet web from the wire part is dried in the first dryer part 7. The dried paper from the first dryer part 7 is sprayed with a binder in a spray part and dried in the second dryer part 14.

Water of the finished stock fed from the former 4 is drained through the wire 5 to form a wet fiber web on the wire 5, which is dewatered to reduce its water content to a predetermined level by means of suction boxes 6 placed under the wire 5. The wet web is introduced into the first dryer part 7 and dried. The first dryer part 7 has a through-air dryer (hereinafter abbreviated as TAD), which has a perforated rotary drum 8 and a hood 9 covering the drum 8 almost hermetically.

Hot air at a prescribed temperature is fed into the hood 9 and enters into the inside of the rotating drum 8. The wet web is wrapped around the drum 8 rotating in the direction indicated by the arrow in FIG. 3. While the web is rotating with the drum, the hot air is blown through the web to dry the web into paper.

The paper obtained in the first dryer part 7 is sprayed with an aqueous solution of a water soluble binder in the spray part. The spray part is located between the first dryer part 7 and the second dryer part 14, which are linked via a conveyor.

The conveyor has an upper conveyor belt 10 and a lower conveyor belt 11 running in the respective directions indicated by the arrows. The conveyor is configured to held the paper dried in the TAD of the first dryer part 7 between the lower run of the upper conveyor belt 10 and the upper run of the lower conveyor belt 11 and carry the paper to the second dryer part 14. At the downstream end of the upper conveyor belt 10 is provided a vacuum roll 12, which is configured to suck the paper to the surface of the upper conveyor belt 10 and carry the paper on the upper run of the upper conveyor belt 10.

As shown in FIG. 3, the spray part has a spray nozzle 13 placed below the second dryer part 14 to face the vacuum roll 12. The spray nozzle 13 is designed to spray a liquid containing a water soluble binder toward the vacuum roll 12 to externally add the binder to the paper.

After addition of the binder, the wet paper form the spray part is transferred to the second dryer part 14 having a yankee dryer. The yankee dryer has a rotary drum 15 and a hood 16 covering the drum 15. The wet paper is wrapped around the rotating drum 15 and dried while rotating.

At the outlet of the yankee dryer is provided a doctor blade 17, which is configured to scrape the paper off the rotating drum 15 while creping the paper. The paper coming off the second dryer part 14 of the paper machine is wound into roll in a winder (not shown).

The water swellable binder-containing, water dispersible fibrous sheet can be prepared in various methods. For example, it is known that a fibrous sheet is obtained by forming a sheet from a pulp stock containing a prescribed amount of a water swellable fibrous binder and drying the resulting wet web (see JP-A-4-370300 and JP-A-2-74694). Such a fibrous sheet can also be produced by a dry papermaking process, in which a mixture of pulp fiber and a water swellable fibrous binder is air laid to form a web, which is then dried.

It is also possible to produce a water dispersible, fibrous sheet containing both a water soluble binder and a water swellable binder by combining the above-described techniques. The water dispersible fibrous sheet containing a water soluble binder and/or a water swellable binder will hereinafter be referred to as base paper.

The base paper, either as obtained or after once stored in roll form, is given water again, embossed to gain bulk in the presence of the water content, and dried simultaneously with or immediately after the embossing to become bulky water-disintegratable paper with a great number of protrusions and depressions. These processing steps can be carried out on, for example, a heat embossing apparatus shown in FIG. 4 that accomplishes drying simultaneously with embossing. The apparatus shown in FIG. 4 has a pair of embossing rolls 18 each having a large number of elevations and recesses on the peripheral surface and fully engaging with each other along the nip line. Each embossing roll 18 rotates in the direction indicated by the arrow. Each embossing roll 18 is made of metal and equipped with a heater (not shown) by which to heat the roll to a predetermined temperature. Although embossing rolls made of metal are advantageous for heating efficiency, one of the embossing rolls may be made of rubber or paper. Upstream the mating embossing rolls 18 is placed a spray nozzle 19, from which water is sprayed on the base paper. The means for adding water is not limited to a spray nozzle and includes a coater and gravure transfer. Steam may be applied in place of water.

Figure 4:
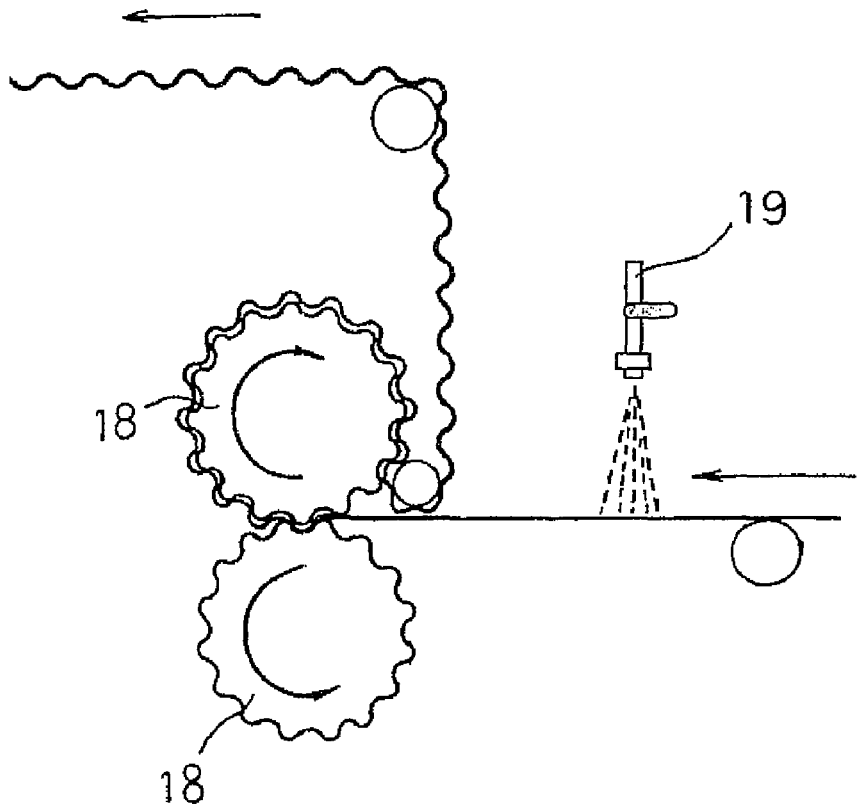
FIG. 4 is a schematic illustration of an embossing machine.

As illustrated in FIG. 4, the base paper unwound from a roll (not shown) is damped with water sprayed from the spray nozzle 19 and forwarded to the embossing machine, where the damp base paper is introduced into the nip between the embossing rolls 18. As stated, since the matched embossing rolls 18 are fully engaged with each other, the three-dimensional pattern on the embossing rolls are impressed into the base paper passing through the nip. While being embossed, the base paper is freed of water by the heat of the embossing rolls 18 to form new fiber-to-fiber bonds. There is thus obtained strong and bulky water-disintegratable paper with numerous protrusions and depressions.

Figure 5:
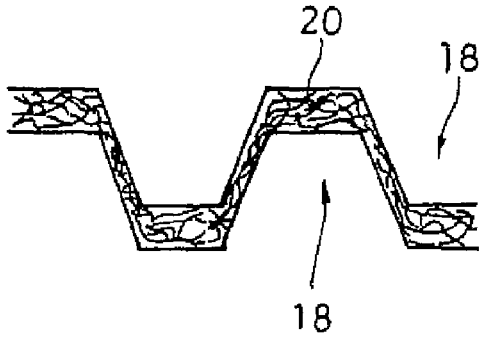
FIG. 5 schematically shows a state of damp base paper being embossed.

FIG. 5 is a schematic illustration of base paper being embossed between matched steel embossing rolls 18. After the base paper is moistened with water spray, the fiber-to-fiber hydrogen bond is weak so that the fibers 20 making up the base paper is ready to be re-arranged on receipt of external force, i.e., re-arranged along the embossing pattern of the steel matched embossing rolls. Thus, while the base paper is passed through the nip between the embossing rolls 18, the fibers 20 are re-aligned in conformity to the three-dimensional pattern of the embossing rolls 18. At the same time, the water content is removed from the wet base paper by the heat of the embossing rolls 18. The result is a re-arranged fiber structure in which the constituent fibers are re-bonded via hydrogen bonds and with the binder. The resulting bulky water-disintegratable paper hardly tears in the side wall of the protrusion 2 (or the side wall of the depression 3). Water disintegratable paper having excellent embossed shape retention can thus be produced with minimized reduction in strength. Impregnated with an aqueous agent containing the aforementioned specific components, the resulting water-disintegratable paper provides the bulky, water-disintegratable cleaning article 1 because the binder is temporarily insolubilized or suppressed from swelling to maintain the fiber-to-fiber bonds, thereby to retain the embossed three-dimensional shape and to ensure the wet strength.

Figure 6:
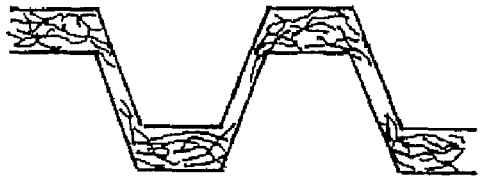
FIG. 6 schematically shows a state of dry base paper being embossed.

If the base paper is shaped between the nip of the embossing rolls 18 in its dry state as commonly practiced, the base paper undergoes large deformation in its thickness direction while maintaining the interfiber hydrogen bonds. It will follow that the interfiber bonds are destroyed or the fibers per se break as depicted in FIG. 6, and a tear occurs easily in the side wall of the protrusion 2 (or the side wall of the depression 3). As a result, the three-dimensional, embossed pattern profile of the resulting paper collapses easily when an outer force is imposed thereto. Moreover, the base paper suffers from considerable reduction in strength as a result of embossing.

Figure 7:
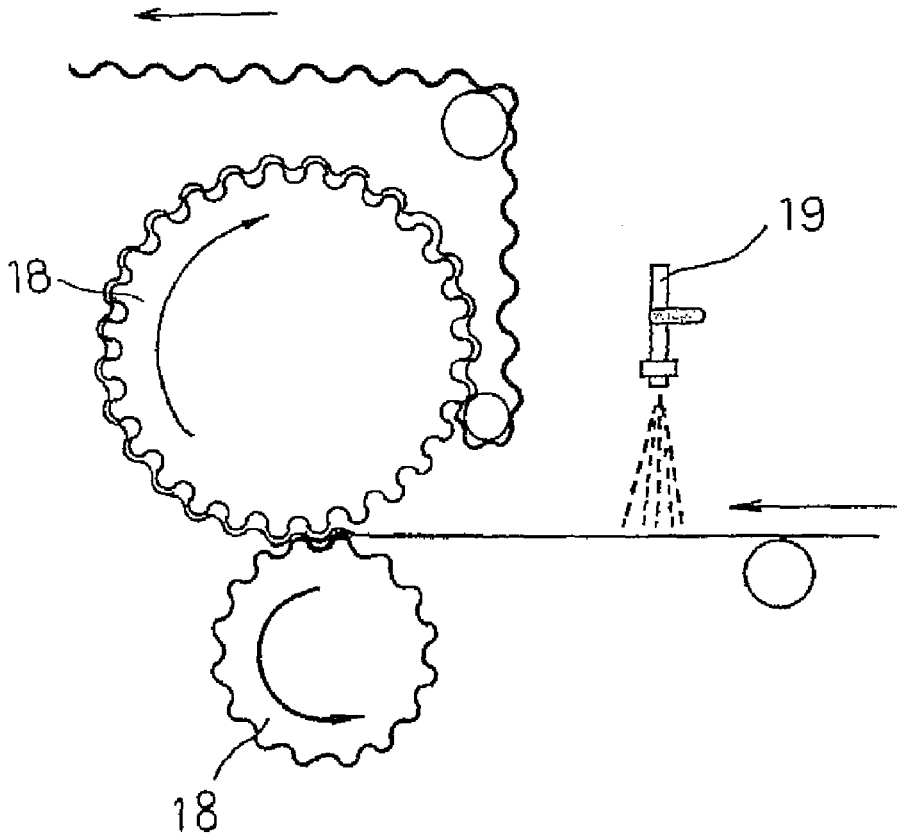
FIG. 7 is a schematic illustration of an embossing machine.
Figure 8:
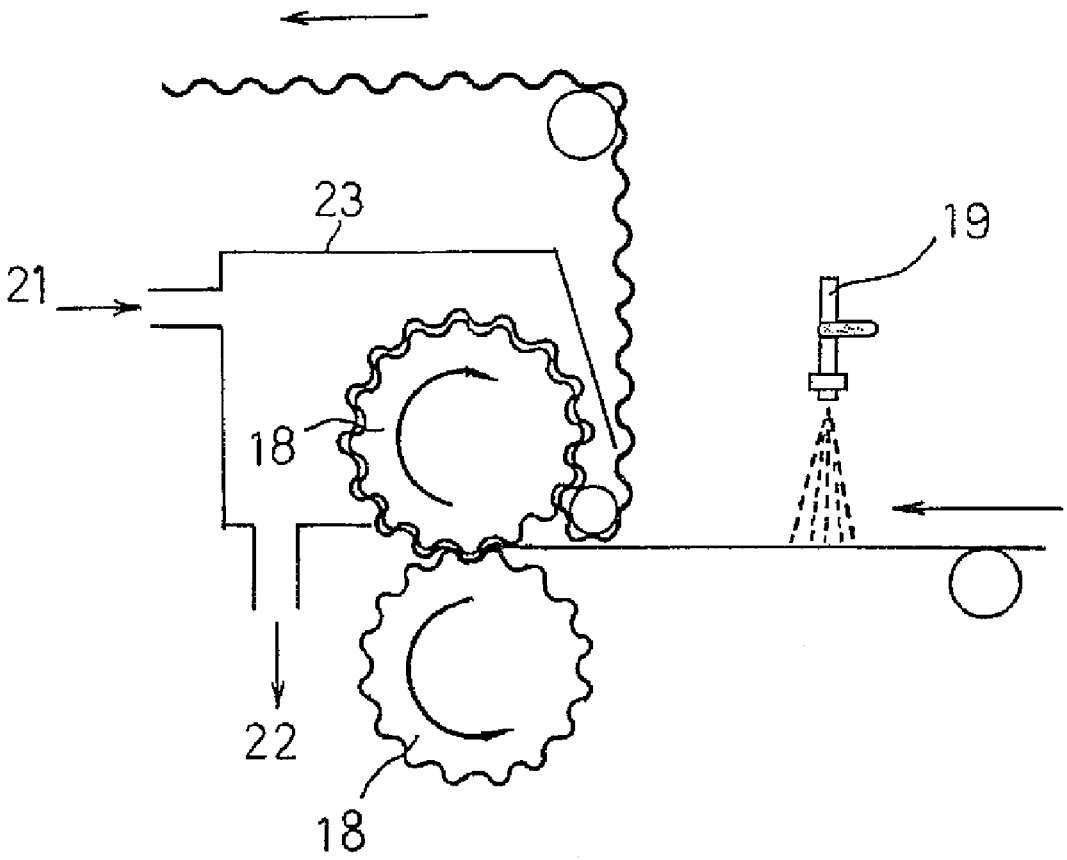
FIG. 8 schematically illustrates an embossing machine combined with a hot air blowing unit.

In order to carry out the embossing successfully, it is necessary to spray water to the base paper to be introduced into the nip between the embossing rolls 18 to give the base paper a water content of 10% to 200% by weight based on the dry weight of the base paper. The water content of the base paper to be embossed is preferably 10% to 130% by weight, more preferably 10% to 50% by weight, even more preferably 10% to 40% by weight. The base paper usually has an original water content of about 5% to 10% by weight. A water content (the original water content plus water sprayed) smaller than 10% by weight is too small to weaken the fiber-to-fiber hydrogen bonds and to swell or dissolve the binder sufficiently, resulting in a failure to induce re-arrangement of the fibers along the embossing pattern. A water content larger than 200% by weight demands wasteful burden of drying. The embossing rolls 18 are preferably heated to 150° to 250° C. to thoroughly dry the base paper. The degree of drying of the base paper often depends on the moving speed of the base paper. As the moving speed increases, it is more likely that only the heat of the embossing rolls is insufficient to dry the base sheet thoroughly. For such a case, the contact time of the base paper with a heat embossing roll 18 can be increased by increasing the diameter of the heat embossing roll about which the embossed sheet is wrapped as shown in FIG. 7, or a hood 23 may be provided to enclose the heat embossing roll 18 about which the embossed sheet is wrapped as shown in FIG. 8. Hot air 21 at a prescribed temperature is blown into the hood 23 and discharged as an exhaust 22 to enhance the drying efficiency. Drying can be performed not only during but also after the embossing. Post-embossing drying is carried out in a separate dryer, such as a TAD or a heat roll, while keeping the embossed shape. It is preferred to add a release agent to the base paper together with water for ease of release of the embossed sheet from the embossing roll. Useful release agents include higher fatty acids, polyethylene wax, silicone oil, mineral oil, and solutions of surfactants.

Figure 9:
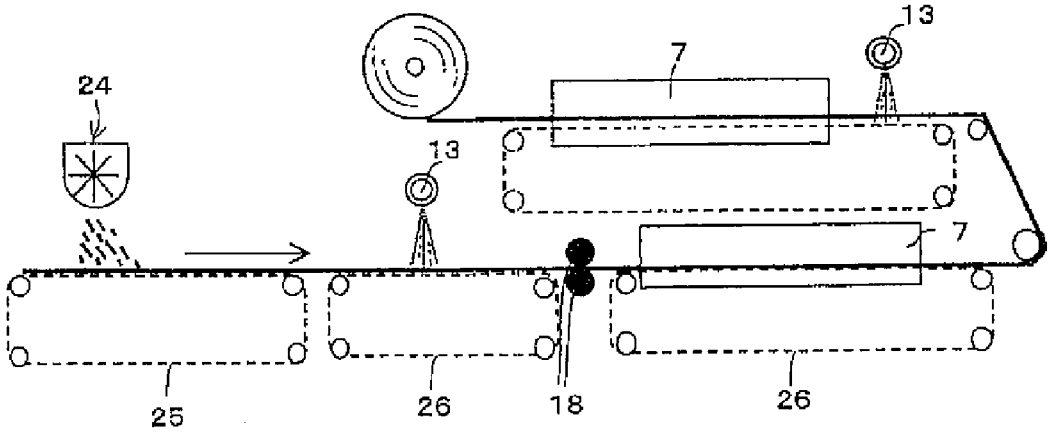
FIG. 9 schematically illustrates an embossing process incorporated into the line of dry papermaking (air laying method).

Another preferred process of producing water-disintegratable paper serving as a base material of the cleaning article 1 includes the steps of providing a sheet containing a substantially water dispersible fiber and containing no water soluble binder by a wet papermaking method or an air laying method, adding an aqueous solution of a water soluble binder with a spray or like means in the line of the wet papermaking method or air laying method to provide a damp fibrous sheet containing a water soluble binder and having a specific water content, embossing the resulting damp fibrous sheet, and drying the fibrous sheet simultaneously with or immediately after the embossing. According to the system shown in FIG. 9, dry staple is opened and conveyed through a former 24 onto a vacuum conveyor 25 to form an air-laid web. The web is sprayed with a water soluble binder aqueous solution through a spray nozzle 13, embossed between a pair of embossing rolls 18, and dried in a through-air drier 7. Reference numerals common to FIGS. 3 and 9 represent the same elements. The description of the first mentioned processes of producing water-disintegratable paper appropriately applies to the particulars of the process illustrated in FIG. 9 that are not referred to here.

Water disintegratable paper can also be produced by processing the sheet containing no water soluble binder by use of the heat embossing apparatus shown in FIG. 4 in which water to be sprayed from the spray nozzle 19 is replaced with an aqueous solution of a water soluble binder. The content of the water soluble binder in the fibrous sheet after sprayed with the water soluble binder solution is 1% to 30% by weight, preferably 2% to 15% by weight, from the viewpoint of bulk retention, wet strength development, and economy. The water content in the fibrous sheet after sprayed with the water soluble binder aqueous solution is 10% to 200% by weight, preferably 10% to 130% by weight, more preferably 10% to 50% by weight, even more preferably 10% to 40% by weight, based on the dry weight of the base paper.

It is preferred that the water-disintegratable paper satisfy the following thickness relationship between Td and Tw. Thickness Td is the thickness of the water-disintegratable paper in its dry state immediately after being embossed measured under a load of 0.3 kPa. The thickness Tw is the thickness of the water-disintegratable paper in the state impregnated with an aqueous agent (i.e., the bulky, water-disintegratable cleaning article) measured under a load of 2.2 kPa. In the manufacture of a water-disintegratable cleaning article, the embossed paper is usually subjected to various processings such as folding, cutting, impregnation, and stacking. The external forces that would be imposed to the embossed paper during these post-embossing processings is estimated at about 2.2 kPa, under which load the Tw measurement is taken. The thickness ratio Tw/Td is a measure of shape retention, i.e., bulk retention. The closer Tw/Td to 1, the higher the shape retention. When the production process of the present invention is followed, the thickness ratio Tw/Td reaches preferably 0.7 or greater, more preferably 0.75 or greater, even more preferably 0.8 or greater. A Tw/Td smaller than 0.7 means that the water-disintegratable paper (i.e., embossed dry paper) has low embossed shape retention against post-embossing processings, showing no noticeable difference from those obtained by conventional embossing techniques.

The Tw value is not significantly affected by the amount of the impregnating aqueous agent within the impregnation ratio of 100 to 500% by weight so that the aqueous agent content is not included in the conditions of measuring Tw. If the amount of the aqueous agent is to be included in the measuring conditions, double the dry weight of the water-disintegratable paper, which is typical in the present invention, would be a suitable condition.

As described above, embossing a fibrous sheet in the presence of a specific water content simultaneously with, or followed by, drying results in formation of a large number of protrusions and depressions without developing a tear nor reducing the strength of the fibrous sheet. By properly choosing embossing rolls, sufficiently high bulk can be attained. The embossed fibrous sheet (i.e., the water-disintegratable paper) exhibits high retention of its three-dimensional profile.

The water-disintegratable cleaning article 1, which is the water-disintegratable paper impregnated with an aqueous agent, does not disintegrate as it is but, when flushed, it disintegrates quickly into fibers. Water disintegratability of a water-disintegratable cleaning article is measured in terms of time required for disintegration specified in JIS P4501-1993 (toilet paper). The shorter the time, the higher the water disintegratability. The time is preferably 100 seconds or shorter, more preferably 60 seconds or shorter.

The cleaning article 1, which is the water-disintegratable paper impregnated with an aqueous agent, is suitable to applications including housekeeping, such as cleaning bathrooms and kitchens; and skin care such as baby wipe, body wipe for nursing and make-up removal. After use, the cleaning article can be flushed for disposal because it disintegrates rapidly in flush water and does not clog pipes.

The present invention is not limited to the above-described embodiments. For instance, the water-disintegratable paper is not limited to a single-layer structure and may be a multi-ply structure. In the latter case, it is preferred that the water soluble or swellable binder be present in at least one of the outermost plies.

The present invention will now be illustrated in greater detail with reference to Examples, but it should be understood that the invention is not deemed to be limited thereto. Unless otherwise noted, all the percents and parts are given by weight.

EXAMPLES 1 TO 8

The apparatus shown in FIG. 3 was used. A wet fiber web was formed from a stock containing 100% NBKP on the wire 5 and dried in the through-air dryer (the first dryer part 7) to reduce the water content to 4%. The resulting paper was carried between a pair of plastic conveyor belts 10 and 11 and sprayed with a 5% aqueous solution of CMC (degree of etherification: 0.9; available from Nippon Paper Chemicals Co., Ltd.) having a viscosity of 1000 mP·s (at 60° C.) through the spray nozzle 13. The amount of the CMC solution applied was 130% based on the weight of the paper, which corresponded to 6.5% CMC. The CMC-containing wet paper was dried in the yankee dryer (the second dryer part 14) and creped with the doctor blade 17 to give CMC-containing paper having a basis weight of 30 g/m$^2$. Separately, CMC-free paper having a basis weight of 30 g/m$^2$ was prepared in the same manner as above, except that the CMC solution was not applied. The resulting two kinds of paper were stacked in the order of CMC-containing paper/CMC-free paper/CMC-containing paper to make a three-ply fibrous sheet having a basis weight of 90 g/m$^2$ for use as base paper.

The base sheet was unrolled and sprayed with a varied amount of water through the spray nozzle 19 shown in FIG. 4. The water content of the thus damped base paper, based on the dry weight of the base paper, is shown in Table 1 below, measured with a heating and drying method moisture analyzer MX-50 available from A & D Co., Ltd. The damp base paper was introduced between the nip of the embossing rolls 18 shown in FIG. 4. The embossing rolls 18 each had a large number of elevations and recesses on the peripheral surface and fully engaged with each other. The embossing pattern had a pitch of 7.0 mm and a depth of the recesses of 2.0 mm. The heating temperature of the embossing rolls is shown in Table 1. The processing speed of the embossing machine was 30 m/min. The base paper was three-dimensionally shaped by the nip of the embossing rolls 18 and dried by the heat of the embossing rolls to give bulky water-disintegratable paper having a thickness of 2 mm under a 0.3 kPa load in a dry state.

The thickness Td of the water-disintegratable paper (in a dry state) under a load of 0.3 kPa was measured. The water-disintegratable paper was impregnated with twice the dry weight of an aqueous agent A described below. The water-disintegratable paper impregnated with the aqueous agent A was measured for thickness Tw under a load of 2.2 kPa and wet strength. Separately, the resulting water-disintegratable paper was folded, cut, impregnated with the aqueous agent A, and packaged into a commodity on a processing machine possessed by the applicant company under the same conditions as ordinarily used. The resulting, commodity-processed water-disintegratable cleaning article was measured for thickness $T_1$ under a load of 0.3 kPa and thickness $T_2$ under a load of 1.0 kPa.

Comparative Example 1

A three-ply base paper having a structure of CMC-containing paper/CMC-free paper/CMC-containing paper and having a basis weight of 90 g/m$^2$ was prepared in the same manner as in Example 1. Without being sprayed with water, the base paper was embossed between a pair of the embossing rolls 18 that were not heated. The embossed paper was impregnated with the aqueous agent A in the same manner as in Example 1 to obtain a water-disintegratable cleaning article.

EXAMPLES 9 AND 10

A wet fiber web was formed on a wet paper machine using a stock containing NBKP and fibrous PVA (Kuraron KII, available from Kuraray Co., Ltd.) at a weight ratio of 90:10 and dried on a yankee dryer to make a sheet having a basis weight of 33 g/m$^2$. Two plies of the sheet were stacked to prepare a fibrous sheet as base paper. The base paper was processed in the same manner as in Examples 1-8, except for using an aqueous agent B having the following composition, to obtain a water-disintegratable cleaning article.

Comparative Example 2

A water-disintegratable cleaning article was obtained in the same manner as in Examples 9 and 10, except that water was not applied to the base paper to be embossed and that the embossing rolls 18 were not heated.

Composition of Aqueous Agent A (Combined with CMC binder):

| | |
|---|---|
| Alkyl glucoside | 0.2% |
| $CaCl_2$ | 3% |
| Propylene glycol monomethyl ether | 13% |
| 3-Methyl-1,3-butanediol | 5% |
| Water | balance |

Composition of Aqueous Agent B (Combined with Fibrous PVA Binder):

| | |
|---|---|
| Alkyl glucoside | 0.2% |
| Boric acid | 3% |
| Propylene glycol monomethyl ether | 13% |
| 3-Methyl-1,3-butanediol | 5% |
| Water | balance |

Evaluation of Performance:

Thickness Td (under 0.3 kPa load) of the water-disintegratable paper obtained in Examples and Comparative Examples, and thickness Tw (under 2.2 kPa load) of the aqueous agent-impregnated water-disintegratable paper obtained in Examples and Comparative Examples were measured. Further, a thickness ratio Tw/Td was calculated based on the respective values of Td and Tw. Thicknesses $T_1$ (under 0.3 kPa load) and $T_2$ (under 1.01 kPa load) of the post-treated water-disintegratable cleaning articles obtained in Examples and Comparative Examples were measured to calculate a thickness ratio, $T_2/T_1$. Furthermore, the wet strength (breaking strength) and water disintegratability of the water-disintegratable cleaning articles were determined according to the following methods. The results obtained are shown in Table 1.

1) Wet Strength (Breaking Strength)

A specimen measuring 100 mm in the MD and 25 mm in the CD was cut out of a sample cleaning article and set on a tensile tester (Tensilon RTA-100, supplied by Orientec Co., Ltd.) at a chuck distance of 50 mm. The specimen was pulled at a rate of 300 mm/min. The strength at break is an ND wet strength. A CD wet strength was measured in the same manner, except that the specimen measured 100 mm in the CD and 25 mm in the MD.

2) Water Disintegratability

Water disintegratability of the water-disintegratable cleaning article was measured in accordance with the method specified in JIS P 4501 using a square specimen the size of which was such that the paper per se (exclusive of the aqueous agent) weighed 0.3 g.

TABLE 1

| | | Basis Weight of Water Disintegratable Paper (g/m2) | | Basis Weight of Water Disintegratable Paper (g/m2) | Amount of Impregnating Aqueous Agent (%) | Thickness of Water Disintegratable Paper (mm) | | | Dry Strength of Water Disintegratable Paper (cN/25 mm) | |
|---|---|---|---|---|---|---|---|---|---|---|
| | | Temp. (° C.) | Water Content based on Base Paper (wt %) | | | Td (Dry, 0.3 kPa) | Tw (Wet, 2.2 kPa) | Tw/Td | MD | CD |
| | | | | | Binder: CMC | | | | | |
| Example | 1 | 200 | 10 | 93.4 | 200 | 2.02 | 1.50 | 0.74 | 3913 | 779 |
| | 2 | 200 | 15 | 92.1 | 200 | 1.98 | 1.61 | 0.76 | 4543 | 901 |
| | 3 | 200 | 20 | 91.5 | 200 | 1.96 | 1.64 | 0.79 | 4898 | 1099 |
| | 4 | 200 | 30 | 91.4 | 200 | 1.98 | 1.80 | 0.81 | 4901 | 1195 |
| | 5 | 200 | 40 | 92.6 | 200 | 2.01 | 1.64 | 0.82 | 4931 | 1341 |
| | 6 | 200 | 70 | 90.9 | 200 | 1.99 | 1.66 | 0.83 | 4970 | 1492 |
| | 7 | 200 | 30 | 91.4 | 300 | 1.98 | 1.55 | 0.76 | 4901 | 1195 |
| | 8 | 200 | 30 | 91.4 | 500 | 1.98 | 1.62 | 0.77 | 4901 | 1195 |
| Comp. Example | 1 | r.t. | 7 | 92.1 | 200 | 2.02 | 1.23 | 0.61 | 2856 | 683 |
| | | | | | Binder: Fibrous PVA | | | | | |
| Example | 9 | 200 | 10 | 71.5 | 200 | 1.80 | 1.38 | 0.77 | 4000 | 751 |
| | 10 | 200 | 30 | 72.9 | 200 | 1.78 | 1.45 | 0.81 | 4265 | 868 |
| Comp. Example | 2 | r.t. | 7 | 72.8 | 200 | 1.88 | 0.99 | 0.53 | 4010 | 701 |

| | | Wet Strength of Water Disintegratable Paper (cN/26 mm) | | Thickness of Commodity-Processed Water Disintegratable Cleaning Article (mm) | | | Wet Strength of Commodity-Processed Water Disintegratable Cleaning Article (cN/25 mm) | | Water Disintegratability of Commodity-Processed Water Disintegratable Cleaning Article (sec) |
|---|---|---|---|---|---|---|---|---|---|
| | | MD | CD | T1 (Wet, 0.3 kPa) | T2 (Wet, 1 kPa) | T2/T1 | MD | CD | |
| | | | | Binder: CMC | | | | | |
| Example | 1 | 607 | 146 | 1.31 | 1.14 | 0.87 | 605 | 144 | 37 |
| | 2 | 741 | 151 | 1.33 | 1.18 | 0.89 | 730 | 150 | 38 |
| | 3 | 743 | 163 | 1.35 | 1.21 | 0.90 | 735 | 169 | 39 |
| | 4 | 752 | 181 | 1.38 | 1.23 | 0.89 | 749 | 179 | 39 |
| | 5 | 760 | 202 | 1.41 | 1.28 | 0.91 | 758 | 200 | 34 |
| | 6 | 773 | 234 | 1.42 | 1.30 | 0.92 | 769 | 233 | 35 |
| | 7 | 758 | 205 | 1.36 | 1.22 | 0.90 | 752 | 201 | 38 |
| | 8 | 703 | 152 | 1.25 | 1.12 | 0.90 | 698 | 160 | 40 |
| Comp. Example | 1 | 631 | 124 | 0.92 | 0.70 | 0.76 | 524 | 122 | 34 |
| | | | | Binder: Fibrous PVA | | | | | |
| Example | 9 | 1390 | 360 | 1.31 | 1.13 | 0.86 | 1379 | 345 | 90 |
| | 10 | 1610 | 410 | 1.37 | 1.24 | 0.91 | 1497 | 402 | 82 |
| Comp. Example | 2 | 1306 | 261 | 0.91 | 0.72 | 0.79 | 1293 | 259 | 78 |

As is apparent from the results shown in Table 1, the bulky, water-disintegratable cleaning articles of the present invention even after commodity-processed into a finished item keep their thickness $T_2$ (under 1.0 kPa) above 0.9 mm at a high ratio to the thickness $T_1$ (under 0.3 kPa), which means excellent embossed shape retention, and also retain the strength. In contrast, the comparative articles undergo considerable thickness reduction when commodity-processed. The comparative articles have low strength. It is seen from the results of Examples that embossing in the presence of a higher water content (as a result of a metered water spray) results in improved embossed shape retention (represented by the thickness ratio after commodity-processing into a finished product, $T_2/T_1$) and improved wet strength.

While not shown in Table 1, each of the bulky, water-disintegratable cleaning articles of Examples was thicker and stronger and fitted in user's hand more comfortably while being used to wipe toilets, etc. clean. as compared with the comparative cleaning articles. The cleaning articles of Examples were capable of scrubbing off dirt and stains easily due to their wet strength. The thickness of the cleaning articles gives a user a sense of security (a sense of distance between the hand and the dirt). Since the sheet thickness is maintained during a wiping operation, a wider area could be wiped clean with a single sheet. From all these considerations, the bulky, water-disintegratable cleaning articles of Examples are proved to be more convenient to use than the comparative ones.

Additionally, the water-disintegratable papers of Examples have a thickness ratio Tw/Td of 0.7 or greater, which indicates shape retention under load, and exhibit higher dry and wet strengths than the comparative ones.

As described above, the bulky, water-disintegratable cleaning article according to the present invention has high bulkiness and, in spite of its wetness, satisfactorily retains the bulk and hardly tears against physical loads such as compression and tension. The embossed shape is retained even after post-embossing steps including cutting, folding, impregnation with a cleaning agent, stacking, and packaging.

The production process according to the present invention provides highly bulky, water-disintegratable paper. Even in a state wetted with an aqueous agent, the water-disintegratable paper produced by the process of the invention retains the embossed shape and hardly tears under physical loads such as compression.

What is claimed is:

1. A process of producing water-disintegratable paper comprising the steps, in the following order, of:

(i) producing a substantially water dispersible fibrous sheet containing at least one of a water soluble binder and a water swellable binder and having a basis weight of 30 to 150 g/m$^2$ by wet process, (ii) drying and storing the fibrous sheet in roll form, (iii) spraying water on the fibrous sheet, (iv) embossing the fibrous sheet in the presence of 10% to 200% by weight of water in the fibrous sheet with heated matched steel embossing rollers having elevations and recesses wherein a difference between the top of the elevations and the bottom of the recesses is 1 to 5 mm, and (v) drying the fibrous sheet simultaneously with or after the embossing;

wherein the fibrous sheet after the embossing step has a number of protrusions and depressions.

2. The process of producing water-disintegratable paper according to claim 1, wherein the step (v) of drying is followed by the step of impregnating the fibrous sheet with an aqueous agent.

3. The process of producing water-disintegratable paper according to claim 2, wherein the aqueous agent contains an agent which insolubilizes the water soluble binder, or an agent which suppresses swelling of the water swellable binder.

4. The process of producing water-disintegratable paper according to claim 1, wherein the fibrous sheet contains 1% to 30% by weight of the water soluble binder or 5% to 40% by weight of the water swellable binder.

5. The process of producing water-disintegratable paper according to claim 1, wherein the water soluble binder has a carboxyl group, and the water swellable binder is a fibrous carboxyl-containing cellulose derivative, a fibrous starch derivative, a fibrous hydroxyl-containing polyvinyl alcohol or a fibrous hydroxyl-containing polyvinyl alcohol derivative.

6. The process of producing water-disintegratable paper according to claim 1, wherein the water-disintegratable paper has a thickness $T_1$ of 1.0 to 3.0 mm under a load of 0.3 kPa and a thickness $T_2$ of at least 0.9 mm under a load of 1.0 kPa.

7. The process of producing water-disintegratable paper according to claim 6, wherein the water-disintegratable paper has a $T_2$ to $T_1$ ratio of 0.8 or higher.

8. The process of producing water-disintegratable paper according to claim 1, wherein the water-disintegratable paper has a thickness ratio Tw/Td of 0.7 or greater.

9. The process of producing water-disintegratable paper according to claim 1, wherein the embossing rollers are heated to 150 to 250° C.

10. The process of producing water-disintegratable paper according to claim 1, wherein the amount of water contained in the fibrous sheet prior to heat-embossing the fibrous sheet is 10 to 200% by weight.

* * * * *